US007185881B2

(12) United States Patent
Drarvik et al.

(10) Patent No.: US 7,185,881 B2
(45) Date of Patent: Mar. 6, 2007

(54) ELECTRIC WINCH

(75) Inventors: Ivar Drarvik, Heiasvingen (NO); Arne Austefjord, Tronesveien (NO)

(73) Assignee: National-Oilwell, L.P., Houston, TX (US)

( * ) Notice: Subject to any disclaimer, the term of this patent is extended or adjusted under 35 U.S.C. 154(b) by 18 days.

(21) Appl. No.: 10/908,043

(22) Filed: Apr. 26, 2005

(65) Prior Publication Data

US 2005/0253125 A1 Nov. 17, 2005

Related U.S. Application Data

(60) Provisional application No. 60/565,750, filed on Apr. 27, 2004.

(51) Int. Cl.
*B66D 1/48* (2006.01)

(52) U.S. Cl. ..... 254/267; 254/256; 254/368

(58) Field of Classification Search ..... 254/267, 254/275, 278, 356, 368, 378
See application file for complete search history.

(56) References Cited

U.S. PATENT DOCUMENTS 3,732,447 A * 5/1973 Perhats ..... 310/76
3,790,814 A * 2/1974 Pfaff et al. ..... 307/119
4,132,387 A * 1/1979 Somerville et al. ..... 254/340
4,545,567 A * 10/1985 Telford et al. ..... 254/344
4,739,969 A * 4/1988 Eckersley et al. ..... 254/378
5,018,603 A * 5/1991 Ito ..... 187/254
5,342,020 A * 8/1994 Stone ..... 254/269
6,995,682 B1 * 2/2006 Chen et al. ..... 340/825.72

FOREIGN PATENT DOCUMENTS

DE 19733299 2/1999
FR 2419249 10/1979

OTHER PUBLICATIONS

European Patent Office Search Report, Appl. No. 05252599.5 dated Oct. 13, 2006; (3 p.).

* cited by examiner

*Primary Examiner*—Emmanuel M Marcelo
(74) *Attorney, Agent, or Firm*—Conley Rose, P.C.

(57) ABSTRACT

Apparatus and methods for operating a winch system comprising a wire spooled onto a drum rotatably mounted to a shaft. A permanent magnet is mounted to the drum such that, when an electric current is applied to a coiled winding mounted to the shaft, the drum rotates about the shaft. The winch comprises a first braking system that controls the rotation of the drum about the shaft by controlling the application of the electric current to the coiled winding. The winch also comprises a second braking system that mechanically engages the drum so as to prevent the rotation of the drum about the shaft. The winch is used in conjunction with a control system that facilitates the use of the winch with lifting and supporting personnel working in elevated environments.

20 Claims, 3 Drawing Sheets

190

ELECTRIC WINCH

CROSS-REFERENCE TO RELATED APPLICATIONS

The present application claims the benefit of, and incorporates by reference, provisional application Ser. No. 60/565,750, filed Apr. 27, 2004, and entitled "Electric Winch."

STATEMENT REGARDING FEDERALLY SPONSORED RESEARCH OR DEVELOPMENT

Not Applicable.

BACKGROUND

The present invention relates generally to methods and apparatus for lifting and hoisting. More particularly, the present invention relates to winches and more specifically for winches used to lift personnel.

In many working environments, personnel are required to perform certain functions at elevated locations where platforms or other working surfaces are not provided. In these situations, a winch, or other type of lifting appliance, is often used to lift and support the worker while performing the task. Among the working environments where winches are commonly used for handling personnel are offshore oil and gas platforms and vessels.

Most facilities have dedicated, specially designed winches that are used only for handling personnel. These winches are known as 'manrider' winches and are often designed with higher safety design factors as compared to standard utility winches. In certain regions, such as both the Norwegian and UK Sectors of the North Sea, manrider winches are subject to stringent rules and regulations as equipment used in handling personnel. Manrider winches, which must safely support a worker in an elevated working position, must also allow that worker some freedom of movement to perform the assigned task. It is often difficult to balance the need for complete safety and fall support with the need to allow the worker being supported some freedom of movement.

Thus, there remains a need to develop methods and apparatus for winches developed within rules and regulations such as those used in the North Sea that govern equipment for handling personnel, which overcome some of the foregoing difficulties while providing more advantageous overall results.

SUMMARY OF THE PREFERRED EMBODIMENTS

The problems discussed above are addressed by apparatus and methods for operating a winch system comprising a wire spooled onto a drum rotatably mounted to a shaft. A permanent magnet is mounted to the drum such that, when an electric current is applied to a coiled winding mounted to the shaft, the drum rotates about the shaft. The winch comprises a first braking system that controls the rotation of the drum about the shaft by controlling the application of the electric current to the coiled winding. The winch also comprises a second braking system that mechanically engages the drum so as to prevent the rotation of the drum about the shaft. The winch is used in conjunction with a control system that facilitates the use of the winch with lifting and supporting personnel working in elevated environments.

The preferred embodiments include an electric winch utilizing a permanent magnet electric motor integrated into the wire rope spool. The permanent magnet electric motor provides resistor induced emergency braking and motor-controlled emergency lowering if power is lost. Because the speed and torque of the motor are easily and precisely controllable, preferred embodiments may include climbing and walking functions to safely support worker movement while maintaining safety. Some embodiments are configured for top of derrick mounting, i.e. reduced number of wire lines. Because the motor is integrated into the drum, the total number of parts required is reduced. The fully electrical winch requires no other power sources, i.e. hydraulic or pneumatic supplies.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
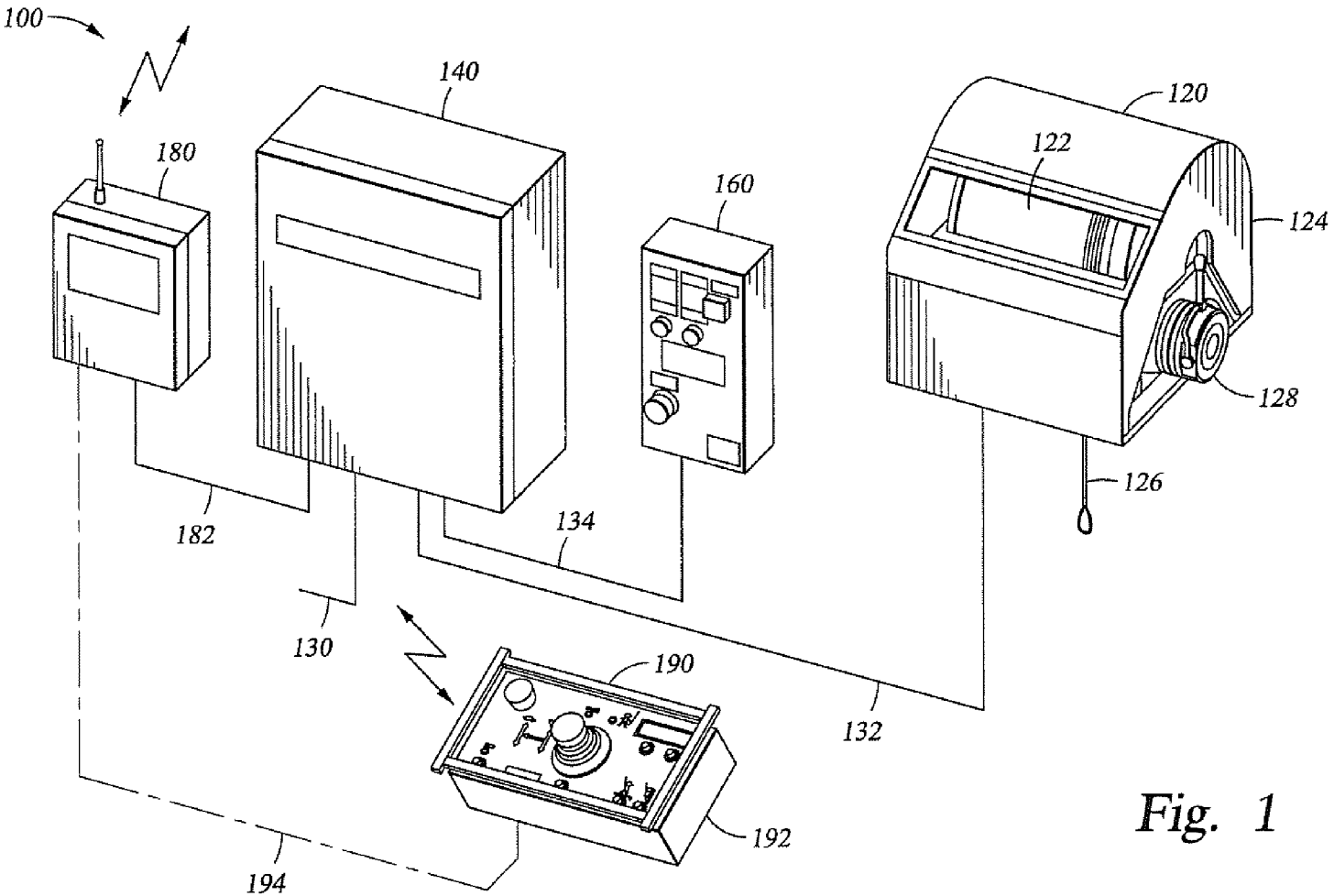
FIG. 1 is a schematic representation of a winch system constructed in accordance with embodiments of the invention.

Referring now to FIG. 1, a schematic diagram illustrating the interconnection of winch system 10 is shown. Winch system 100 comprises winch 120, control panel 140, local operator station 160, base unit 180, and remote control 190. Winch 120 is an electric motor operated drum 122 mounted in frame 124. Wire 126 is reeled on drum 122 and extends from the bottom of frame 124. Mechanical braking system 128 is mounted to drum 122.

Control panel 140 is supplied by power cable 130 and includes the electronics required to operate winch 120. These electronics may include programmable logic controllers with a control system, a frequency drive, a power distribution system, resistors, and electric relays and barriers. Control panel 140 supplies control signals and power to winch 120 along connection 132.

Local operator station 160 is connected to control panel 140 via connection 134, which transmits control signals for winch 120 to control panel 140. Local operator station 140 may include a full set of control switches including activators for emergency functions such as stop and lowering. Local operator station 160 is fixably mounted to the facility in a desired location. Several local operator stations 160 may be connected to a single control panel 140 and be equipped with interlocks to prevent the use of more than one operator station at a time. Similarly, one local operator station 160 may selectively communicate with several control panels 140 to control a selected winch 120.

Base unit 180 and remote control 190 operate together to provide remote, mobile operation of winch 120. Base unit 180 comprises a radio communication unit that can be housed in a safe area and is connected to and communicates with control panel 140 via connection 182. Remote control 190 includes operator controls 192 and a radio transmitter to transmit signals 194 to base unit 180. In some embodiments, remote control 190 may be connected to base unit 180 by a cable.

Figure 2:
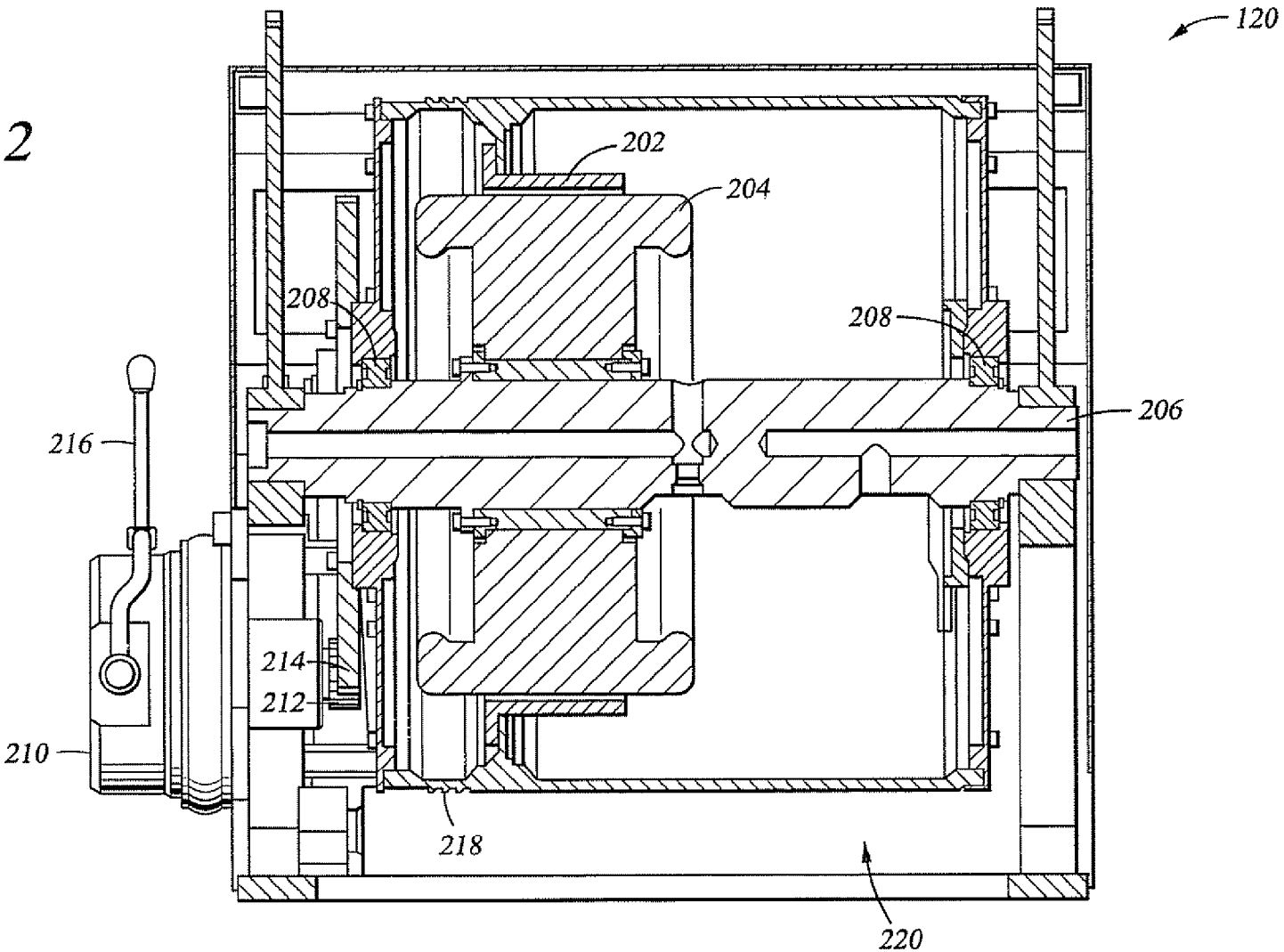
FIG. 2 is a cross-sectional view of the winch of FIG. 1.

A cross-sectional view of winch 120 is shown in FIG. 2. Winch 120 includes frame 124, drum 122, and braking system 128. Winch 120 is preferably built for overhead installation, with wire running downwards in order to reduce wire wear and eliminate slack wire and spooling problems like backlash. Winch 120 is preferably built as an inside out permanent magnet motor where drum 122 rotates about shaft 206. The motor is frequency controlled, giving full control over motor speed and torque.

Drum 122 surrounds and is fixably attached to rotor 202 that includes permanent magnets. Rotor 202 is disposed about stator 204 that is fixably connected to shaft 206 and is formed from coiled windings. Shaft 206 and stator 204 are stationarily connected to frame 124 such that when a current is applied to stator 204, drum 122, supported by bearings 208, rotates about shaft 206. Drum 122 is preferably made with right hand winded grooves spooling of one layer of 10 mm wire. The speed of the drum is monitored by an external digital encoder.

Braking system 128 may include three different braking systems, namely an electric motor brake, an external fail safe brake, and a motor magnet brake. The electric motor operates as an electric motor brake by reducing the speed and torque of the rotor by reducing the electrical current supplied to the coiled windings. The speed and torque can be monitored by the control system, and the motor speed controlled to reduce and stop the drum according to the operator signals. An external fail safe brake 210 is energized and disengages when the winch is started. Brake 210 controls pinion 212 that engages gear 214 that is connected to drum 122. Brake 210 will stay disengaged until winch 120 is turned off or an emergency switch is pressed. Brake 210 will also engage in case of power failure and can be manually disengaged by actuating lever 216. In case of power failure to the motor and a failure of brake 210, the motor will start acting as a dynamo. In this mode drum 122 will rotate and pay out wire a constant slow rate according to the loading in the wire. High speed emergency lowering will be impossible.

Winch 120 may also be equipped with an arrangement for manual release of the brake. This manual release may be actuated directly at winch 120 or actuated from drill floor via a pneumatic system. A manual pneumatic valve on the drill floor supplies air to a pneumatic cylinder on the winch activating brake lever 216. When the air is shut off, the brake is applied. The winch speed will still be limited by the resistor arrangement.

To ensure correct wire spooling, winch 120 is preferably made for only one layer of wire on drum 122. In addition to this, the drum is fitted with grooves 218. The wire is guided onto the drum using spooling device 220 that directs the wire into the grooves.

The power system that operates winch 120 may also comprise a frequency converter including braking chopper for running the winch motor clockwise and counterclockwise. A braking resistor may be used for dissipating regenerated energy when braking with the electrical motor. A contactor/resistor arrangement may be supplied to short circuit the motor windings for braking in case of loss of frequency converter and for protection against motor overvoltage. The winch control system can be equipped with a separate potential free contactor that can be connected to other drill floor machines emergency shut down circuits, disabling other connected machinery when the winch is in operation. On drilling rigs with advanced drilling control and monitoring system, the winch can easily be incorporated into the rig's anti collision system. The winch may also be fitted with a heave compensating system, making it possible to work on fixed well equipment on a floating vessel.

Figure 3:
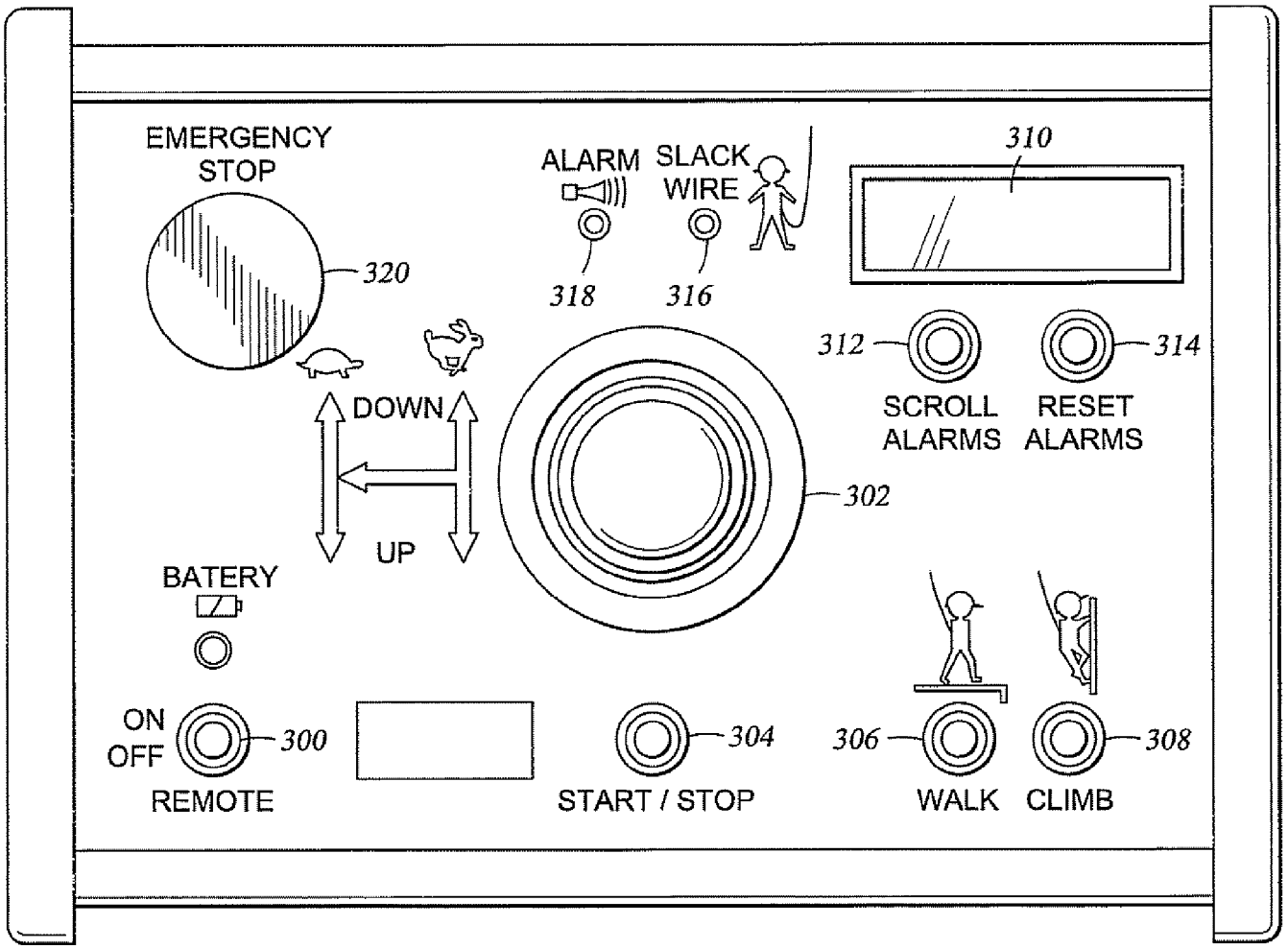
FIG. 3 is a layout view of a remote control unit of the system of FIG. 1.

One embodiment of remote control 190 is shown in FIG. 3. Remote control 190 includes on/off switch 300, joystick 302, start/stop switch 304, walk button 306, climb button 308, display 310, display controls 312 and 314, warning lights 316 and 318, and emergency stop button 320. Once remote control 190 is activated by on/off switch 300, pushing the start/stop switch 304 will send a pulse signal to control panel 140 to initiate a start sequence during which, the motor will be powered up, the brake resistor arrangement disabled and the brake released. Pushing the start/stop switch 204 again will initiate a stop sequence during which, motor speed is set to zero, the mechanical brake is applied, and the brake resistor arrangement is enabled. When the shut down sequence is confirmed, the motor is powered down.

To operate the winch upwards or downwards, joystick 302 is utilized. Joystick 302 is preferably fitted with a dead man's grip, i.e. a separate activation switch in the joystick handle. The activation switch must be pressed with joystick 202 in the zero position in order to start operations. If the activation switch is released during operation with joystick 202 out of the zero position, the winch will continue running but a new start from the zero position requires depressing of the activation switch. When receiving the hoist signal from joystick 202, the frequency converter will change the motor speed according to joystick position. The maximum hoisting speed and acceleration is limited by the control system.

When lowering the load in normal operation, the frequency converter/braking chopper will measure the DC-bus voltage and start operating (dissipating regenerated energy in the braking resistor) when exceeding the preset limit. Max tension in the wire will be controlled by the frequency converter. In case of excessive external force, the tension will not exceed a programmable hard-coded value. The winch will be equipped with a sensor for upper and lower position stops such that a signal from this sensor will cause the winch to stop at downwards position independently of other control signals. The joystick can be operated in "left" position, in this position the winch is in creep speed mode, giving maximum 10% of normal speed.

Winch 120 may be equipped with a climb function 308 that can be selected/deselected at the remote control panel. When selected, the rider can adjust his position by applying additional force in downwards or relieving tension in an upward direction. Maximum speed limits in both directions are 0.15 m/s when this function is activated. The operator can at all time take control of the movement by using the joystick, which deactivates the climb function.

Winch 120 may also be equipped with a walk function 306 that can be selected/deselected at the remote control panel. When activated, winch 120 will keep a constant low tension in the wire, preventing a slack wire situation. The rider can move around with a small pull in the wire. The function can only be activated when the load is below 15% of max load. In case of a person falling from an elevated position with this function activated, the person will be lowered with a preset speed of 0.15 m/s. The operator can at all time take control of the operation of the winch, either by activating the joystick, which deactivates the walk function.

When the control system detects "slack wire", a red indicator lamp 216 will illuminate on the console. The slack wire function will stop downwards movement if the wire tension drops below 2% of max tension.

Referring back to FIG. 1, winch 120 is equipped with three emergency stops located at remote control console 190, at local operator station 160 and at winch 120. These are hard wired emergency stop buttons 220 (see FIG. 3) that will engage the mechanical brake, engage the magnetic brake and disconnect power from the motor. Pressing the emergency stop switch 220 will immediately stop winch 120 and apply the parking brake. The power to the motor will also be shut down but control system 140 will still be monitoring winch 120. Any detection of internal failures, including overspeed, overpull, power problems, and communication problems, will also produce an emergency shutdown.

To be able to lower the load in case of equipment failure or loss of power, winch 120 is equipped with an emergency lowering circuit. This arrangement will lower the load in a controlled manner in case of loss of power from the frequency converter. If the mechanical brake is engaged and the PLC/remote control is working, the brake can be released by operating an emergency release switch at local operator station 160. The control power to the emergency brake release circuit comes from the rig UPS system. A diode bridge will allow for dual brake release signal, both for the PLC (in normal operation) and for the emergency lowering circuit. Overspeed detection will still be operating, and if overspeed is detected, the brake will engage.

In case of failure in the PLC/remote control system, but with UPS power available, the load can be lowered by activating the emergency lowering switch at local operator station 160. In case of no UPS power available, the mechanical brake can be disengaged manually by a hand operated lever 216 (see FIG. 2) on the brake. In this mode, the winch speed will still be limited by the resistor arrangement and all control system safety features are disabled. Emergency lowering speed is always limited by the motor braking resistance (dynamo effect) and the load being lowered. Free fall will never be possible except for wire breakage or complete mechanical failure of the winch.

Winch 120 can also be equipped with an arrangement for manual release of the brake from drill floor. A manual pneumatic valve on the drill floor can supply air to a pneumatic cylinder on the winch activating brake lever 216 (see FIG. 2). When the air is shut off, the brake is applied. The winch speed will still be limited by the resistor arrangement. An emergency hoisting feature can also be included, wherein a crank handle can be inserted onto the drum, and the winch wire may be manually spooled in at a gear ratio of 1:8.

At loss of main power to the frequency converter, the mechanical brake will engage and the contactor/emergency lowering resistor arrangement will make sure that the motor does not generate overvoltage at the motor terminals. In case of loss of power to the PLC, the mechanical brake will engage and the contactor/emergency lowering resistor arrangement will make sure that the motor does not generate overvoltage at the motor terminals.

PLC failure will cause the mechanical brake to engage and the emergency lowering contactor will short-circuit the motor windings over the emergency lowering resistor arrangement.

If the PLC detects a failure in remote control system 190, winch 120 will be shut down in a safe sequence. All special functions will be shut off. Speed will be set to zero, and the mechanical brake will be applied. Remote control failure will cause the mechanical brake to engage and the emergency lowering contactor will short-circuit the motor windings over the emergency lowering resistor arrangement. Failure on the remote control system 190 will not affect operation from local operator station 160, which always can be activated.

Frequency converter failure will cause the mechanical brake to engage and the contactor/emergency lowering resistor arrangement will make sure that the motor does not generate overvoltage at the motor terminals.

At all times, the PLC will monitor and regulate the speed of the winch drum by use of two independent sensors. In case of speed exceeding the preset limit, the PLC will engage the mechanical brake. The detection has the same priority in the emergency stop loop as the emergency stop push button.

At all times, the PLC will monitor the wire tension through the motor torque. In case of tension exceeding the preset limit, the winch will pay out wire unless the speed exceeds the overspeed limit. As a backup torque measurement, the input current to the frequency converter is monitored. If the current exceeds a preset limit, the winch will be stopped and shut down.

The PLC may be equipped with a system monitoring and diagnosing software. This software monitors the PLC, frequency converter and remote radio control status, and also the communication links and instrumentation on the winch. Any fault detected will generate an alarm. Alarms generate a message that will be displayed on the LCD-screen 310 on the remote radio console 190 (see FIG. 3).

The remote radio console 190 may be equipped with a system monitoring and diagnosing software. Internal errors related to the remote radio console 190 will be displayed on the LCD-screen 310 on the console. The frequency converter is equipped with a system monitoring and diagnosing software. Internal errors related to the frequency converter will be displayed on an LCD-screen on the frequency converter.

The unique features of this winch are derived from the electrical motor that is used. This is a slow rotating permanent magnet motor integrated into the drum that provides very good torque control, which can be used for various new functions. Also, this motor will produce torque even at loss of power, so normal free falling is impossible.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the winch apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. A winch comprising:

a wire spooled onto a drum rotatably mounted to a shaft;

a permanent magnet mounted to the drum such that when an electric current is applied to a coiled winding mounted to the shaft, the drum rotates about the shaft;

a first braking system that controls the rotation of the drum about the shaft by controlling the application of the electric current to the coiled winding; and a second braking system that mechanically engages the drum so as to prevent the rotation of the drum about said shaft.

2. The winch of claim 1 further comprising a third braking system that limits the speed of the rotation of the drum about the shaft if no electric current is applied to the coiled winding.

3. The winch of claim 1 wherein said second braking system comprises a gear mounted to the drum and a pinion operable to engage the gear and limit rotation of the drum about the shaft.

4. The winch of claim 3 wherein said second braking system further comprises a manual release mechanism that disengages the pinion from the gear.

5. The winch of claim 4 wherein the manual release mechanism is actuated by a pneumatic cylinder.

6. The winch of claim 1 wherein said second braking system is a fail safe braking system that is disengaged when electric current is applied to the coiled winding.

7. The winch of claim 1 further comprising a frame supporting the shaft, wherein the wire extends from a bottom of the frame.

8. A winch system comprising:

an electric winch comprising a wire spooled onto a drum rotatably mounted to a shaft, wherein a permanent magnet is mounted to said drum such that, when an electric current is applied to a coiled winding mounted to the shaft, the drum rotates about the shaft;

a control panel coupled to said electric winch and to a power supply, wherein said control panel is operable to provide the electrical current to said electric winch; and a control station coupled to said control panel, wherein said control station generates control signals that are transmitted to said electric winch by said control panel.

9. The winch system of claim 8 wherein said electric winch comprises a first braking system that controls the rotation of the drum about the shaft by controlling the application of the electric current to the coiled winding; and a second braking system that mechanically engages the drum so as to prevent the rotation of said drum about said shaft.

10. The winch system of claim 8 wherein said control station comprises:

a start/stop switch that activates said electric winch and disengages the second braking system;

a joystick that controls the direction and speed at which the drum rotates about the shaft; and an emergency stop button that deactivates said electric winch and engages the second braking system.

11. The winch system of claim 10 wherein said control station further comprises a mode select switch that controls the mode in which the winch operates.

12. The winch system of claim 11 wherein the mode select switch operates said electric winch in mode that maintains a constant tension in the wire.

13. The winch system of claim 8 wherein said control station is a portable unit that communicates with said control panel via radio signals.

14. A method for operating a winch system comprising:

activating a control station that comprises control inputs for an electric winch, wherein the electric winch comprises a wire spooled onto a drum that is rotatably mounted to a shaft, wherein a permanent magnet is mounted to the drum such that, when an electric current is applied to a coiled winding mounted to the shaft, the drum rotates about the shaft;

initiating a start sequence for the electric winch wherein power is supplied to the coiled winding and a mechanical braking system is released; and operating a joystick so as to control the direction and speed of the rotation of the drum about the shaft.

15. The method of claim 14 wherein the direction and speed of the rotation of the drum are controlled by varying the electric current applied to the coiled winding.

16. The method of claim 14 further comprising operating the electric winch in a climb function wherein the vertical position of the wire can be adjusted by applying or relieving tension from the wire.

17. The method of claim 14 further comprising operating the electric winch in a walk function wherein a constant tension is maintained in the wire.

18. The method of claim 14 further comprising activating an emergency stop that applies the mechanical brake and stopping the supply of electric current to the coiled winding.

19. The method of claim 14 further comprising initiating a shut down sequence wherein the mechanical braking system is engaged and power is shut off from the coiled winding.

20. The method of claim 14 wherein the control station communicates via radio signals.

* * * * *